US006513773B1

(12) United States Patent
Chang et al.

(10) Patent No.: US 6,513,773 B1
(45) Date of Patent: Feb. 4, 2003

(54) STRUCTURE WALL-MOUNTED ARTICLES HANGER

(76) Inventors: Ching-Yi Chang, No. 101-1, Sec. 1, Chang Ho Road, Changhua City (TW); Ching-Chih Chang, No. 59, Sec. 2, Chang Mei Road, Ho-Mei Township, Changhua (TW)

( * ) Notice: Subject to any disclaimer, the term of this patent is extended or adjusted under 35 U.S.C. 154(b) by 0 days.

(21) Appl. No.: 09/987,063

(22) Filed: Nov. 13, 2001

(51) Int. Cl.[7] ..... A47F 5/08
(52) U.S. Cl. ..... 248/231.91; 248/289.11
(58) Field of Search ..... 248/231.9, 231.91, 248/289.11, 110, 282.1; 211/70.6, 65, 88.03

(56) References Cited

U.S. PATENT DOCUMENTS

| | | | | | |
|---|---|---|---|---|---|
| 200,082 | A | * | 2/1878 | Nolan | 248/207 |
| 232,461 | A | * | 9/1880 | Coolbaugh | 248/539 |
| 245,855 | A | * | 8/1881 | Morrison | 433/79 |
| 262,009 | A | * | 8/1882 | Cutler | 248/289.11 |
| 321,887 | A | * | 7/1885 | Cross | 248/297.31 |
| 541,863 | A | * | 7/1895 | Loomis | 248/289.11 |
| 573,985 | A | * | 12/1896 | Kunz | 248/289.11 |
| 1,539,277 | A | * | 5/1925 | Schenck | 248/289.11 |
| 2,110,598 | A | * | 3/1938 | Henry | 156/19 |
| 5,630,517 | A | * | 5/1997 | Maznik | 211/70.6 |

* cited by examiner

*Primary Examiner*—Ramon O. Ramirez
*Assistant Examiner*—Kofi Schulterbrandt
(74) *Attorney, Agent, or Firm*—Rabin & Berdo, P.C.

(57) ABSTRACT

An Improved Structure wall-mounted articles hanger that addresses the shortcomings of conventional wall hanger mount structures and in which the top and bottom sections of a mounting fixture of predetermined design (such as a hemispherical body) have respectively disposed an anchoring hole as well as a recess that provides for the fitting over of a cover. A round opening is formed in the top section recess and after its alignment with a threaded hole through a swing slot horizontally formed along the center of the said mounting fixture and an insert hole formed in the inner end of a hanger member, a bolt is inserted and fastened, and various objects are then clipped to or suspended from the outer end of the hanger member. As such, a single mounting fixture accommodates the installation of different application hanger members that are pivotable and interchangeable and, furthermore, the said hanger members are capable of remaining stationary or rotated to a desired angle.

6 Claims, 4 Drawing Sheets

STRUCTURE WALL-MOUNTED ARTICLES HANGER

BACKGROUND OF THE INVENTION

1) Field of the Invention

The invention herein relates to an Improved Structure wall-mounted articles hanger that addresses the drawbacks of conventional wall-mounted articles hanger structures.

2) Description of the Prior Art

A conventional wall-mounted articles hanger structure is typically fabricated such that the mounting fixture and the hanger member consist of a one-piece unit, with the hanger member capable of serving as a holder for towels, wash cloths, cups, tooth brushes, toilet brushes, bar soap, platform glass, single or double hooks, liquid bath soap, and toilet paper (in a length-adjustable arrangement).

However, when the various arrangements of the one-piece hanger members are produced, manufacturers are faced with mold fabrication difficulties, the additional molding costs adversely affecting factory productivity, while also increasing the price of such products since the cost is passed on to consumers.

Therefore, in view of the fabrication and utilization shortcomings of the conventional wall-mounted articles hanger structures, the inventor of the invention herein innovatively improved and perfected the product to further refine it into an advanced structure having greater functionality which culminated in the successful development of the invention herein, which is submitted as a new patent application.

SUMMARY OF THE INVENTION

The primary objective of the invention herein is to provide improvements over the shortcomings of conventional wall-mounted articles hanger structures, wherein the top and bottom sections of a mounting fixture of predetermined design (such as a hemispherical body) has respectively disposed an anchoring hole as well as a recess that provides for the fitting over of a cover; furthermore, a round opening is formed in the top section recess and after its alignment with a threaded hole through a swing slot horizontally formed along the center of the mounting fixture and an insert hole formed in the inner end of a hanger member, a bolt is inserted and fastened, and various objects are then clipped to or suspended from the outer end of the hanger member; as such, a single mounting fixture accommodates the installation of different application hanger members that are pivotable and interchangeable and, furthermore manufacturers produce them utilizing one mold such that any type of hanger member can be movably installed specifically its outer end to clip, suspend, or position an assortment of objects (such as towels, wash cloths, cups, tooth brushes, toilet brushes, bar soap, platform glass, single or double hooks, liquid bath soap, and toilet paper) as required and that can be designed in differing shapes; furthermore, said hanger members are capable of remaining stationary or rotated to a desired angle as required; fabricating the mold just one time reduces production costs and increases factory productivity to maximum levels, while the price of such products is reduced and the return benefits are enjoyed by consumers, which are among the objectives and solutions of the present invention.

BRIEF DESCRIPTION OF THE INVENTION

DETAILED DESCRIPTION OF THE INVENTION

Figure 1:
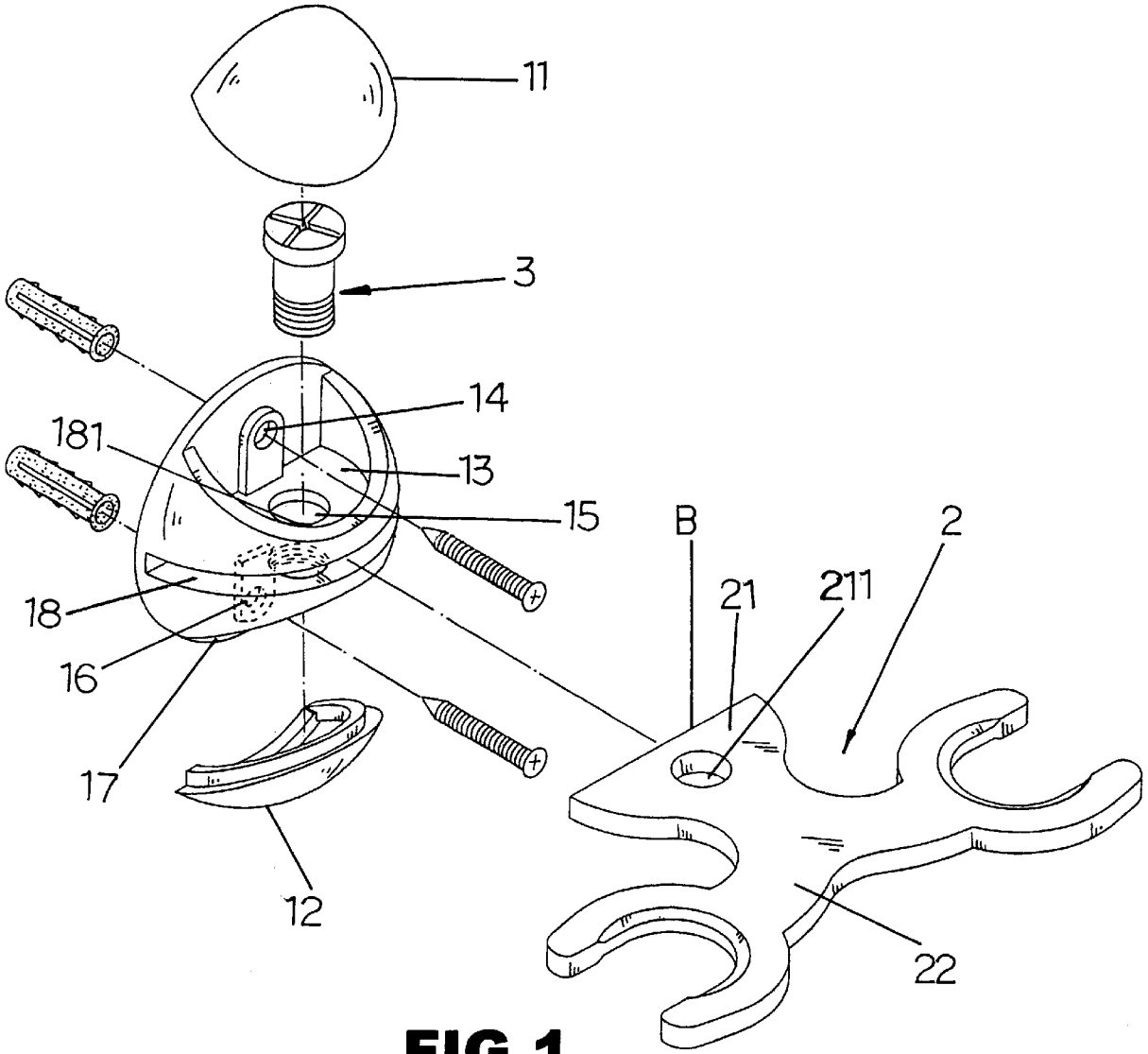
FIG. 1 is an exploded drawing of the invention herein.

Referring to FIG. 1, the wall-mounted articles hanger is comprised of a mounting fixture 1 of a predetermined design (such as a hemispherical body), the top and bottom sections of which have, respectively, an anchoring hole 14 and 16, as well as a recess 13 and 17 that provides for the fitting over of a cover 11 and 12. Furthermore, a round opening 15 is formed in the top section recess 13. After aligning the opening 15 with a centered threaded hole 181 through a swing slot 18 horizontally formed along the center of the mounting fixture 1, and with an insert hole 211 formed in the inner end 21 of various hanger members 2, a fastener, such as a bolt 3 is inserted and fastened. Various objects are then clipped to or suspended from the outer end 22 of the hanger members 2. As such, a single mounting fixture 1 capable of effectively accommodating the installation of a range of different application hanger members 2 is produced utilizing one mold such that any type of hanger member 2 can be pivotably installed (specifically its outer end 22 to clip, suspend, or position an assortment of objects (such as towels, wash cloths, cups, tooth brushes, toilet brushes, bar soap, platform glass, single or double hooks, liquid bath soap, and toilet paper) as required, which can be designed in differing shapes). Fabricating the mold just one time reduces production costs and increases factory productivity to maximum levels, while the price of such products is reduced and the return benefits are enjoyed by consumers. Furthermore, the hanger members 2 are capable of remaining stationary or rotated to a desired angle during utilization. During usage, a consumer or a company determines the quantity of mounting fixtures 1 it needs as well as the matching types of hanger members 2 to be pivotably conjoined therein. Furthermore, the inner end 21 can be fabricated curved or straight to suit the operational mode of the swing slot 18 horizontally formed along the center of the mounting fixture 1.

The preceding section is further elaborated by the structural components and complete structure provided in the figures listed by the brief description of the drawings relating to the patent application claims of the invention herein.

Figure 2:
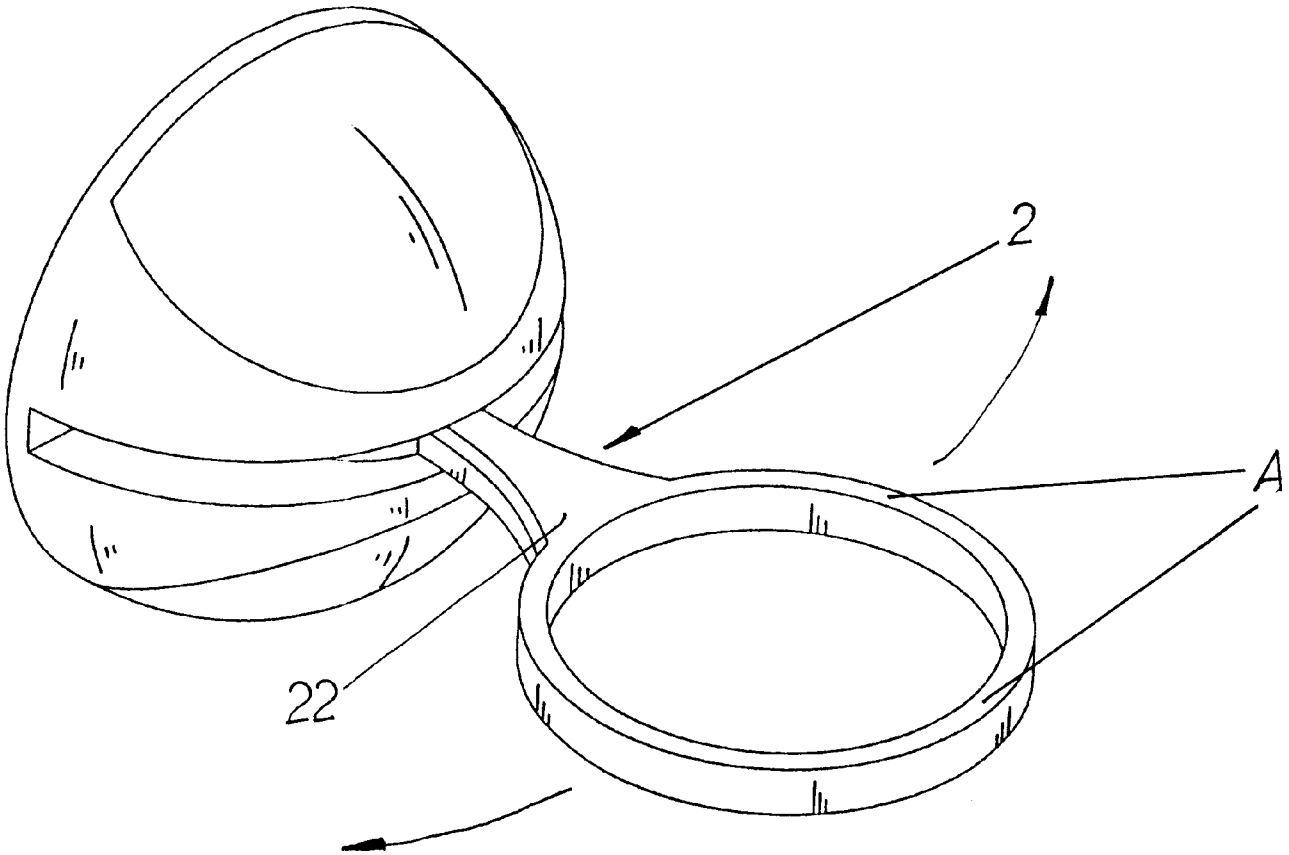
FIG. 2 is an isometric drawing of the hanger member of the invention herein.

FIG. 2 illustrates an embodiment of the hanger member 2 of the invention herein. The outer end 22 of a round shape A that serves as a cup holder—or a toothbrush holder or soap dish—fabricated to carry various kinds of cups and, furthermore, the curved profile of the hanger member 2 allows its rotation to various angles as required.

Figure 3:
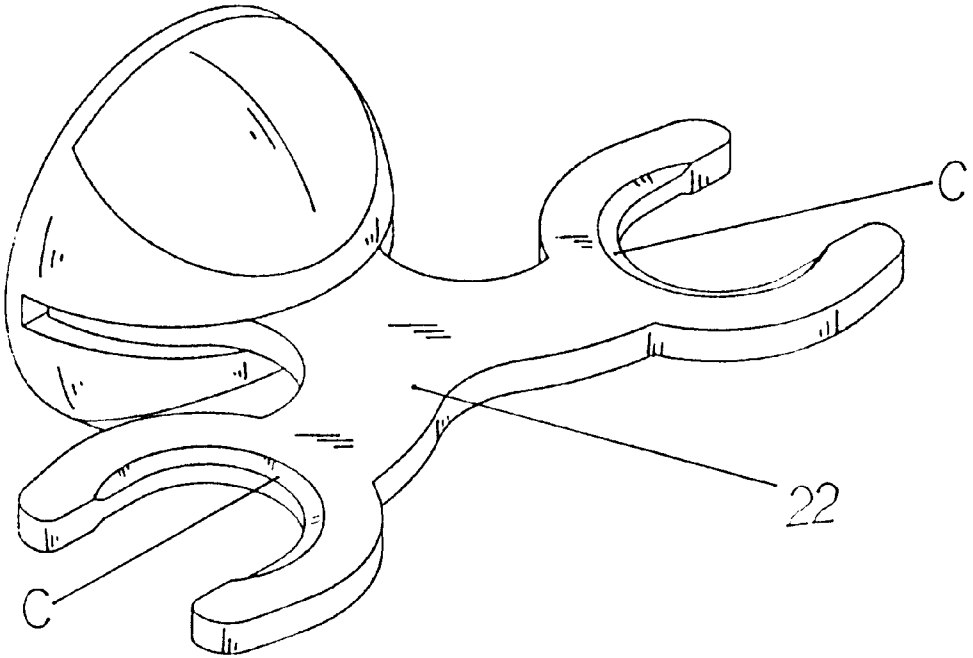
FIG. 3 is an isometric drawing of another hanger member embodiment of the invention herein.

FIG. 3 is an auxiliary drawing of the hanger member 2 illustrated in the full structure of the present invention shown in FIG. 1.

The inner end 21 is of a straight profile B and tightly fitted within the swing slot 18 such that the hanger member 2 is in a stationary state for this particular application. Since the outer end 22 of the hanger member 2 is designed with C-shaped clefts C, liquid bath soap or laundering detergent containers and so on can be suspended from them.

Figure 4:
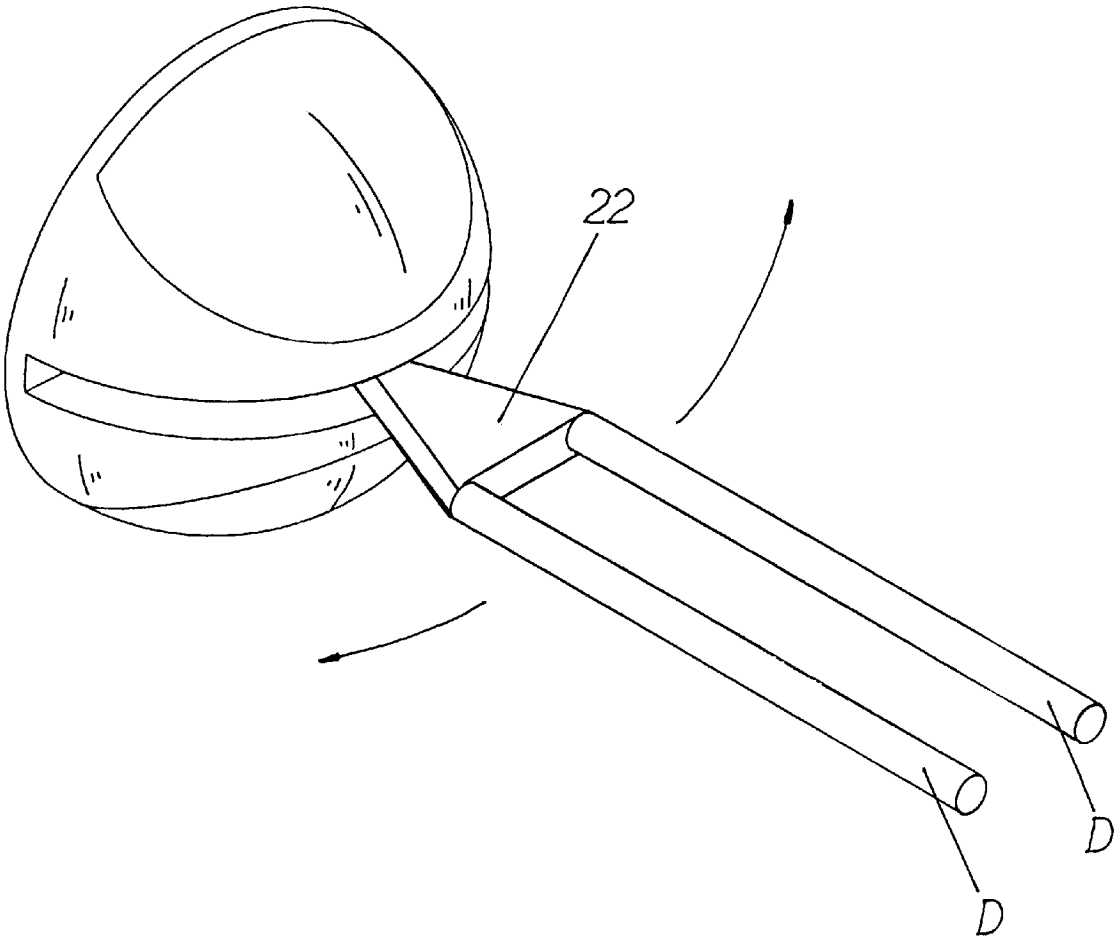
FIG. 4 is an isometric drawing of yet another hanger member embodiment of the invention herein.

FIG. 4 is yet another embodiment of the invention herein. Since the outer end 22 of the hanger member 2 is designed as straight tubular elements D, fabric objects such as bath and hand towels can be draped onto the hanging area and, furthermore, the hanger member 2 is of a curved profile to allow its rotation to varying angles as required.

In summation of the foregoing section, since the mounting fixture 1 of the invention herein possesses industrial utility and, furthermore, is original and progressive, the present invention meets new patent application requirements. However, the preceding description only discloses a few most preferred embodiments and shall not be construed as a limitation of the scope and claims of the invention herein. All modifications and embellishments based on the application claims of the invention herein shall remain included within the patented claims of the present invention.

What is claimed is:

1. A wall-mounted hanger, comprising:

a mounting fixture, having:

a top section having a first recess, a first anchor hole, and a round opening;

a bottom section having a second recess, a second anchor hole, and a threaded hole disposed in alignment with the round opening;

a first cover that covers the first recess;

a second cover that covers the second recess;

a horizontally-formed swing slot that separates the top section from the bottom section; and a bolt that is insertable through the round opening and threadable into the threaded hole; and a kit of interchangeable hanger members, each hanger member having:

an inner end that is insertable into the horizontally-formed swing slot, the inner end having an insert hole that is alignable with the round opening and the threaded hole, the bolt passing through the insert hole when the bolt is inserted through the round opening and threaded into the threaded hole to fasten the hanger member to the mounting fixture; and an outer end to which various articles are clipable or suspendable therefrom, wherein the mounting fixture individually accommodates all of the hanger members of the kit of interchangeable hanger members; and wherein at least one of the hanger members of the kit of interchangeable hanger members is pivotal relative to the mounting fixture when attached thereto.

2. The wall mounted hanger recited in claim 1, wherein the inner end of the at least one of the hanger members of the kit of interchangeable hanger members has a curved profile which allows the hanger member to pivot relative to the mounting fixture, and the inner end of at least another one of the hanger members of the kit of interchangeable hanger members has a straight profile which retains the hanger member in a stationary position relative to the mounting fixture.

3. The wall mounted hanger recited in claim 1, wherein the outer end of at least one of the hanger members of the kit of interchangeable hanger members has a round shape so as to be adapted to serve as a cup holder.

4. The wall mounted hanger recited in claim 1, wherein the outer end of at least one of the hanger members of the kit of interchangeable hanger members has a C-shaped cleft.

5. The wall mounted hanger recited in claim 1, wherein the outer end of at least one of the hanger members of the kit of interchangeable hanger members has straight tubular draping elements.

6. A wall-mounted hanger, comprising:

a mounting fixture, having:

a top section having a first recess, and a round opening;

a bottom section having a second recess;

a first cover that covers the first recess and the round opening;

a second cover that covers the second recess;

a horizontally-formed swing slot that separates the top section from the bottom section; and a fastener that is insertable through the round opening; and a kit of interchangeable hanger members, each hanger member having:

an inner end that is insertable into the horizontally-formed swing slot, the inner end having an insert hole that is alignable with the round opening, the fastener passing through the insert hole when the fastener is inserted through the round opening to fasten the hanger member to the mounting fixture; and an outer end to which various articles are clipable or suspendable therefrom, wherein the mounting fixture individually accommodates all of the hanger members of the kit of interchangeable hanger members; and wherein at least one of the hanger members of the kit of interchangeable hanger members is pivotal relative to the mounting fixture when attached thereto.

* * * * *